United States Patent [19]

Uglow

[11] Patent Number: 4,799,713

[45] Date of Patent: Jan. 24, 1989

[54] ROOF DRAIN COUPLING

[76] Inventor: Katharine A. Uglow, 72 Gihon Spring Dr., Rexdale, Ontario, Canada

[21] Appl. No.: 156,988

[22] Filed: Feb. 18, 1988

[30] Foreign Application Priority Data

Feb. 20, 1987 [CA] Canada ..... 530215

[51] Int. Cl.[4] ..... E04B 5/48

[52] U.S. Cl. ..... 285/42; 285/363; 210/163

[58] Field of Search ..... 210/163–166; 285/42, 363, 405; 52/15

[56] References Cited

U.S. PATENT DOCUMENTS

| | | | |
|---|---|---|---|
| 1,487,161 | 3/1924 | Holt | 210/363 |
| 1,753,262 | 4/1930 | Cromwell | 210/363 |
| 1,988,669 | 1/1935 | Somerfeld | 210/363 |
| 2,091,927 | 8/1937 | Hirshstein | 210/166 |
| 2,283,365 | 5/1942 | Heinkel | 210/363 |
| 2,284,416 | 5/1942 | Gordon | 285/346 |
| 2,666,493 | 1/1954 | Gordon | 210/363 |
| 2,740,490 | 4/1956 | Matheis | 210/363 |
| 3,517,813 | 6/1970 | Thaler | 210/166 |
| 3,893,919 | 7/1975 | Flegel et al. | 210/166 |
| 4,505,814 | 3/1985 | Marshall | 210/166 |
| 4,652,365 | 3/1987 | Ebeling | 210/165 |

*Primary Examiner*—Bernard Nozick

*Attorney, Agent, or Firm*—Riches, McKenzie & Herbert

[57] ABSTRACT

A drain assembly is disclosed having a drain insert member with a tube portion carrying at its upper end a flange which extends radially outwardly. A clamp ring member is adapted to overlie and be clamped onto the flange member. The flange has a plurality of post members which extend upwardly from the upper surface of the flange. The clamp ring member has a plurality of upwardly extending socket forming members each defining a socket recess open at a lower surface of the clamp ring member and adapted to receive a post member in the socket recess therein. A screw member extends downwardly through the top of the socket forming member to engage the post member and draw the clamp ring member downward onto the flange in clamping arrangement therewith. The upstanding post members and socket forming members permit the drain insert member to be made by injection moulding from a two piece mould. Further, their location is independent of the diameter of the tube portion of the drain insert member so that a single size clamp ring member can be used on a number of drain insert members having a similar flange but different internal diameter tube portions.

10 Claims, 4 Drawing Sheets

16
86
82
84
18

14

64
12
23
28
20

14
74
12
72
28
20

ROOF DRAIN COUPLING

SCOPE OF THE INVENTION

This invention relates to roof drains and more particularly to an improved configuration for coupling a clamp ring member to a flange of a roof drain insert member.

BACKGROUND OF THE INVENTION

Many known roof drain assemblies comprise a roof drain insert member and a clamp ring member to overlie and be clamped onto a top flange of the insert member. Typically, internal lugs are provided on both the clamp ring member and the top flange which extend radially inwardly into the tubular drain. This has the disadvantage that the lugs can restrict flow of water. To prevent excessive interference with water flow, the lugs are located closely adjacent inside walls of the tubular drain. To accomplish this, however, for each different size tubular drain, a different size clamp ring is required. Provision of internal lugs makes it very difficult to mould drain insert members in that two piece moulds can not be used and more complex mould constructions are required. A further disadvantage of the internal lugs is that their use results in concentration of forces on the lugs increasing the likelyhood of failure and possible leakage.

Screws to secure typical clamp ring members onto flanges of the drain insert members are located flush with or below the upper surface of the ring members. This has the disadvantage that the holes into which the screws are to be placed or the screws themselves are frequently hidden and covered with tar, asphalt or other sealants applied to the roof about the roof drain insert. This can be a substantial inconvenience and loss of time during installation.

SUMMARY OF THE INVENTION

Accordingly, to at least partially overcome these disadvantages of previously known devices, the present invention provides a roof drain insert with an upper flange having upstanding hollow post members adapted to extend upwardly into socket recesses in the lower surface of a clamp ring member, which socket recesses are provided internally in socket forming members extending upwardly through the clamp ring member and above the upper surface of the clamp ring member.

An object of the present invention is to provide an improved assembly for coupling clamp ring members over an upwardly directed flange of a roof drain insert member.

An other object is to provide a series of roof drain inserts compatable with different diameter drain pipes yet with which a single size clamp ring member can be used.

An other object is to provide a roof drain insert which can be moulded from plastic using a two piece mould.

Accordingly, in one of its aspects, the present invention provides a roof drain assembly comprising a drain insert member having a tube portion with an upper opening and a lower opening plus a flange extending outwardly about the upper opening, a thin planar clamp ring member overlying the flange with a central opening through the clamp ring member to provide access to the upper opening of the tube portion, a plurality of post members on the flange extending upwardly beyond an upper surface of the flange, each post member having a central aperture extending downwardly from the top of each post member into the post member but not entirely through the flange, a plurality of socket forming members on the clamp ring member extending upwardly beyond an upper surface of the clamp ring member, each socket forming member defining therein a socket recess to receive a post member therein through an opening to the socket recess in a lower surface of the clamp ring member, an entrance aperture through an upper end of each socket forming member downward into the socket recess, and screw means extending downwardly via the entrance aperture into the socket means to engage in the central aperture of the post means and urge the clamp ring member downwardly into sealed clamping engagement on top of the flange.

In another aspect the present invention provides a roof drain assembly comprising:

a drain insert member having a tube portion with flange means extending outwardly about an upper opening of the tube portion, removable clamp ring means overlying the flange means, post means on the flange means extending upwardly from an upper surface of the flange means, socket forming means on the clamp ring means extending upwardly beyond an upper surface of the clamp ring means, a socket recess in each socket forming means to receive one of the post means therein through an access opening to the socket recess in a lower surface of the clamp ring member, screw means extending downwardly through the socket forming means into the socket recess to engage the post means and urge the clamping ring means downward into clamping engagement on top of the flange means.

A drain assembly in accordance with the invention includes a drain insert member with a tube portion carrying at its upper end a flange which extends radially outwardly. A clamp ring member is adapted to overlie and be clamped onto the flange member. The flange has a plurality of post members which extend upwardly from the upper surface of the flange. The clamp ring member has a plurality of upwardly extending socket forming members each defining a socket recess open at a lower surface of the clamp ring member and adapted to receive a post member therein. A screw member extends downwardly through the top of the socket forming member to engage the post member in the socket recess and draw the clamp ring member downward onto the flange in clamping arrangement therewith. The upstanding post members and socket forming members permit the drain insert member to be made by injection moulding from a two piece mould. Further, their location is independent of the diameter of the tube portion of the drain insert member so that a single size clamp ring can be used on a number of drain insert members having a similar flange but different internal diameter tube portions.

BRIEF DESCRIPTION OF THE DRAWINGS

Additional advantages and features of the present invention will appear from the following description taken together with the accompanying drawings in which.

DETAILED DESCRIPTION OF THE DRAWINGS

Figure 1:
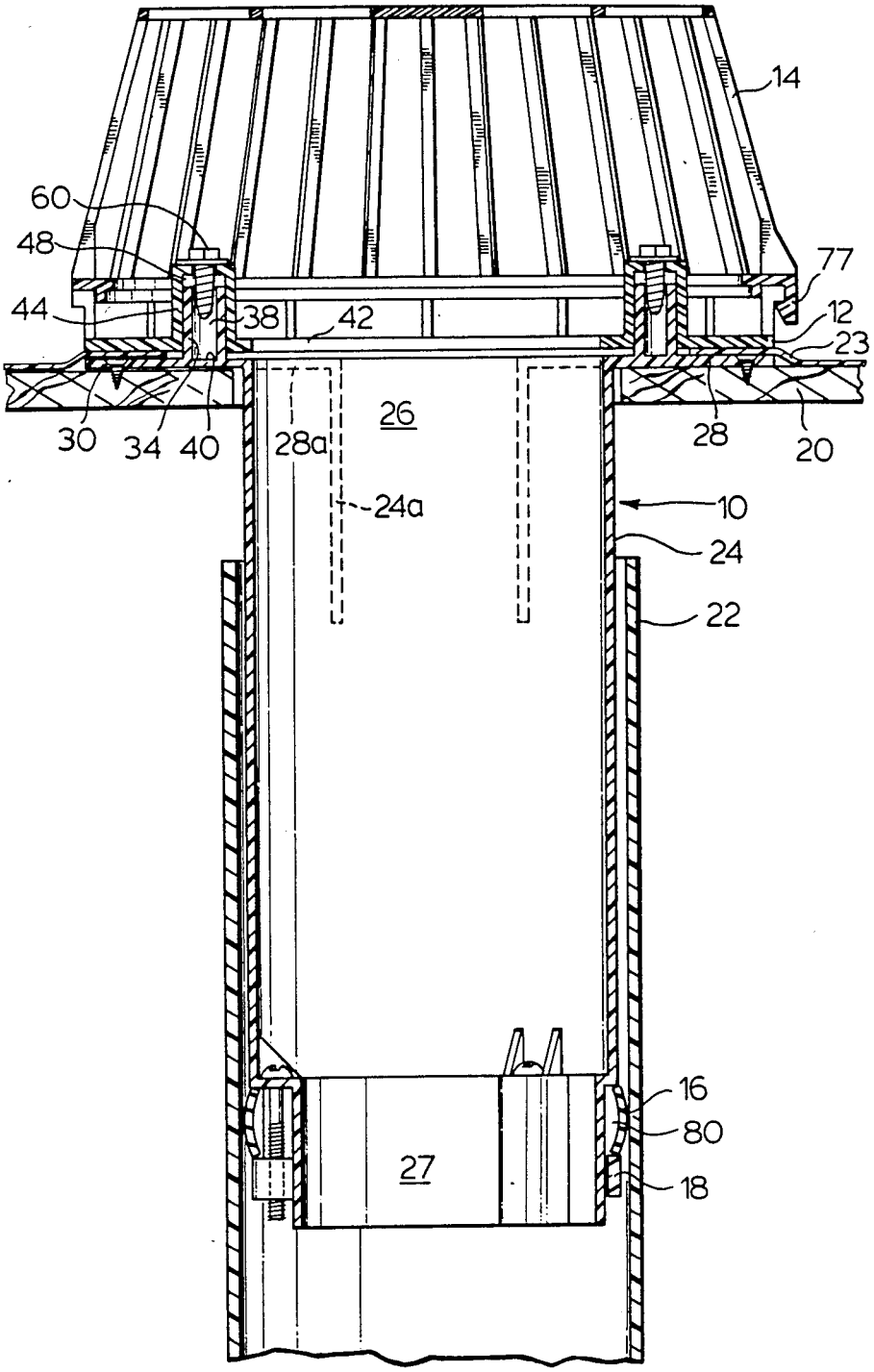
FIG. 1 is a cross-sectional side view of a roof drain assembly in accordance with the present invention.
Figure 3:
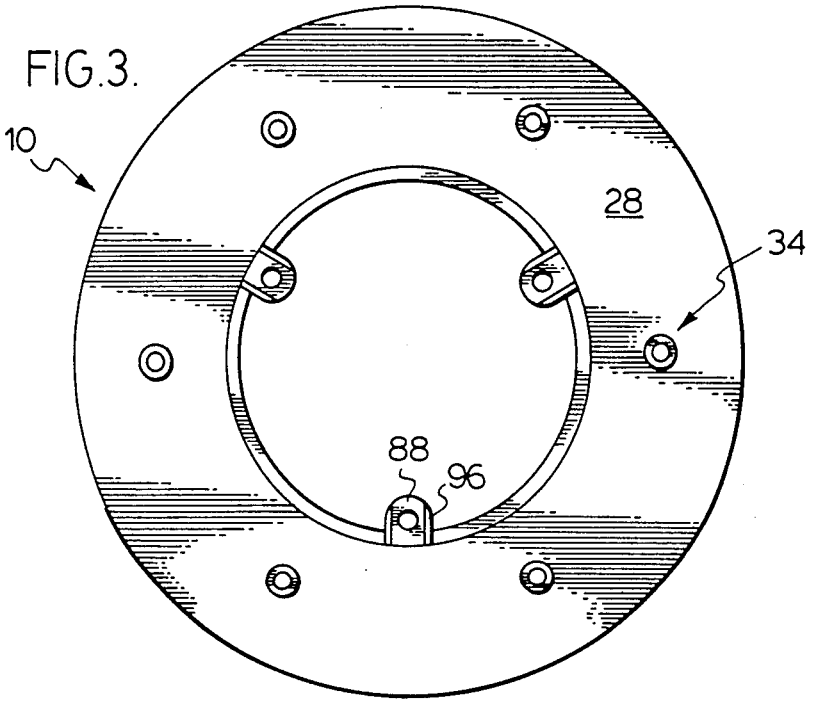
FIG. 3 is a top, elevation view of a drain insert member comprising part of the assembly shown in FIG. 1.
Figure 2:
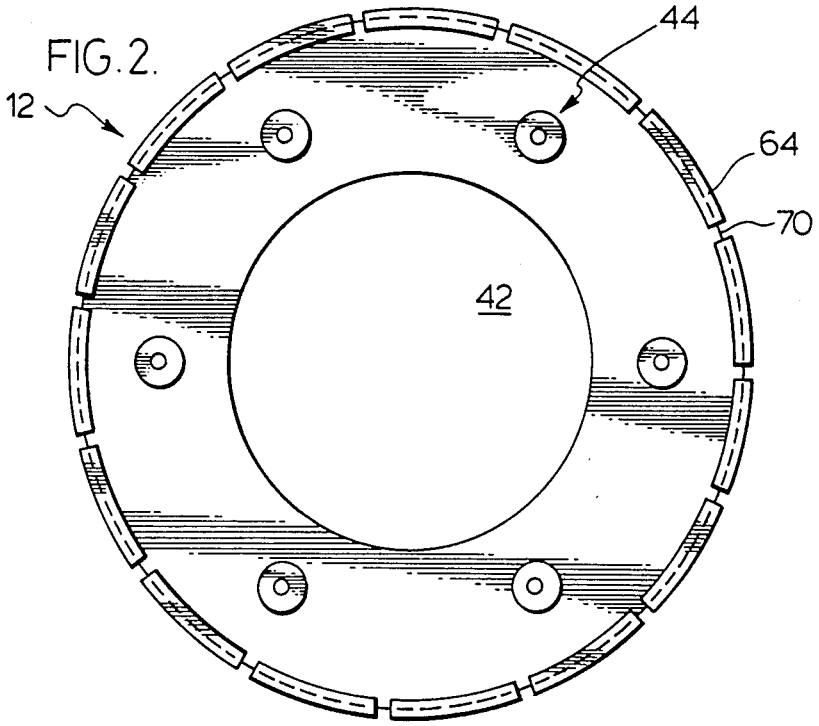
FIG. 2 is a top, elevation view of a clamp ring member comprising part of the assembly shown in FIG. 1.

Reference is made first to FIG. 1 which shows a roof drain assembly in accordance with the present invention comprising roof drain insert member 10, clamp ring member 12, straining basket 14, seal ring 16 and washer 18.

The assembly is shown in FIG. 1 in the context of a roof generally indicated 20 supported by means not shown and below which a drain pipe 22 is located also supported by means not shown. A thin water impermeable sheeting 23 covers roof 20. The roof drain assembly is sealed to both sheeting 23 and drain pipe 22 and serves to transfer water collected on the roof to the drain pipe 22.

Drain insert member 10 has a cylindrical tube portion generally indicated 24 with an upper opening 26 at its upper end and a lower opening 27 at its lower end. Member 10 also has a thin, planar flange 28 extending radially outwardly about upper opening 26. Flange 28 has circumferentially spaced, counter-sunk holes 30 therein, through which recessed head screws 32 extend to secure flange 28 to roof 20 with a lower surface of flange 28 in locating abutment with an upper surface of roof 20.

Flange 28 carries six post members 34 which extend upwardly beyond upper surface 36 of flange 28. Each post member 34 is shown to be substantially cylindrical and to have a central aperture 38 which extends downwardly into post member 34. Central aperture 38 does not extend entirely through flange 28 but rather terminates as a blind end 40. With post members 34 extending upwardly from flange 28, flange 28, as shown, has a flat lower surface to sit flush onto roof 20. Post members 34 in extending upwardly from flange 28 do not cause interference on inserting the drain insert member into a pre-existing drain.

Clamp ring member 12 overlies flange 28 with a central opening 42 through ring member 12 to provide access to tubular portion 24 via upper opening 26. Substantial portions of ring member 12 are relatively thin and planar.

Six socket forming members 44 are provide on ring member 12 each rising above the upper surface 46 of ring member 12. Socket forming members 44 each define a socket recess 48 therein. Recess 48 has a lower opening 50 in lower surface 52 of ring member 12. Socket forming members 44 constitute a generally cylindrical upstanding wall 58 which at its upper end preferably extends radially inwardly to provide an inwardly extending flange 56 at the top of member 44. An entrance aperture extends downwardly through the top of each member 44 into socket recess 48.

Socket forming members 44 are complementarily located having regard to the location of post members 34 so that each socket recess 48 may receive a post member 34 therein.

Screw member 60 extends downwardly through the top of socket forming member 44 via the entrance aperture and into central aperture 38 of a post member 34 received inside socket recess 48. Screw member 60 engages post engages post member 34 to urge ring member 12 down onto flange 28. Preferably screw member 60 carries a washer 62 to distribute loads onto socket forming member 44.

With sheeting 23 located between flange 28 and ring member 12 circumferentially about flange 28, sheeting 23 can be clamped between ring member 12 and flange 28 to form a seal entirely about the periphery of the drain assembly.

Although not necessary, screws 32 fastening flange 28 to roof 20 may be located under sheeting 23 and flush with the upper surface of flange 28.

Figure 4:
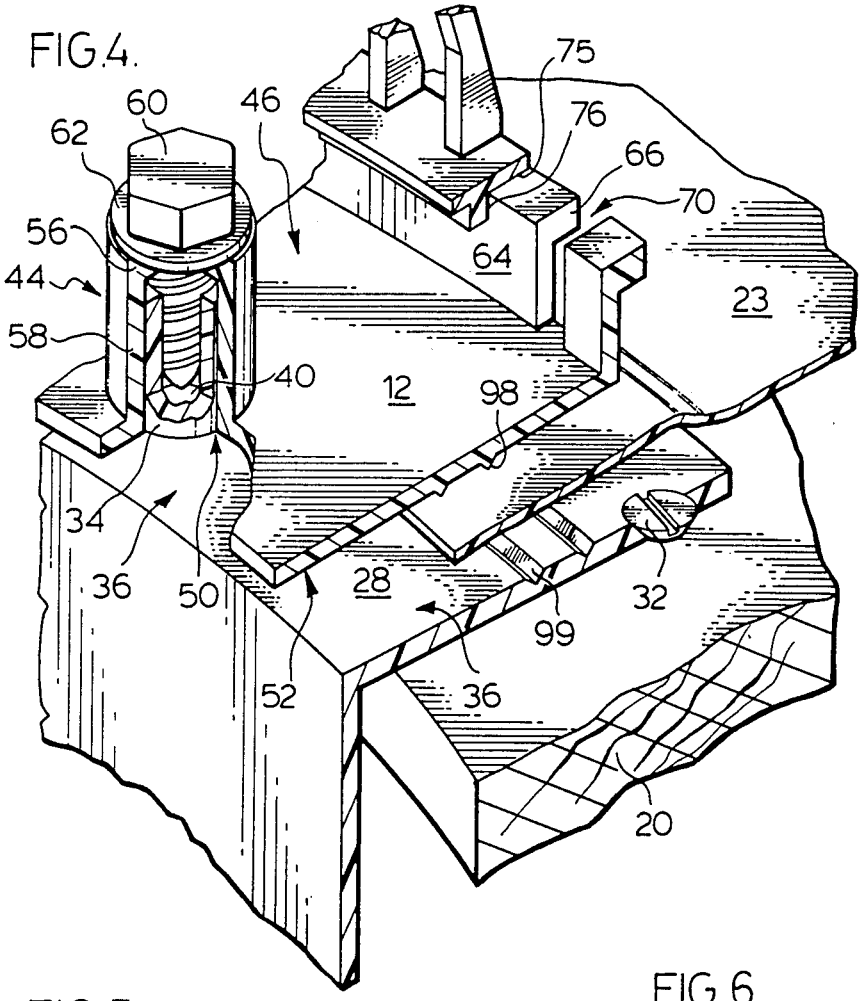
FIG. 4 is a partially cut away pictorial view showing a segment of the roof drain assembly of FIG. 1.
Figure 5:
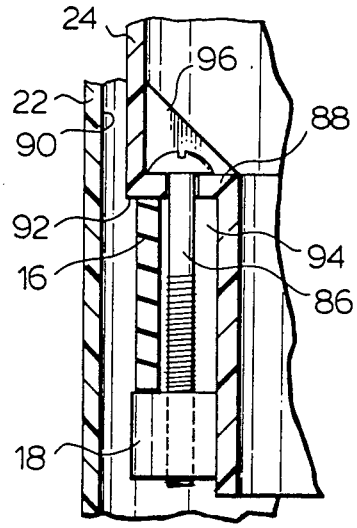
FIG. 5 shows an enlarged cross-sectional side view of the lower end of the assembly of FIG. 1 in an unsealed configuration.
Figure 6:
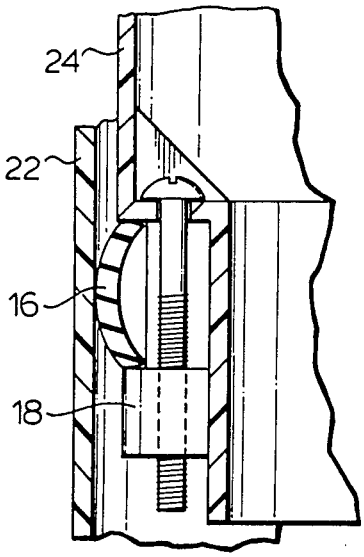
FIG. 6 is a view similar to FIG. 5 but showing a sealed configuration.
Figure 7:
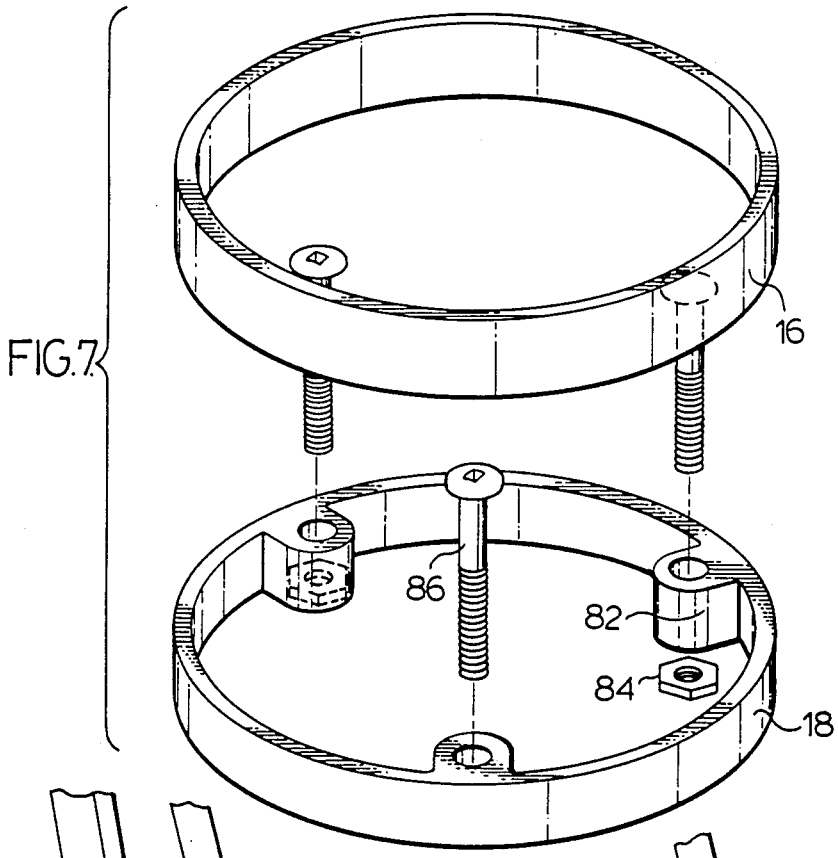
FIG. 7 shows in an exploded, schematic view, screws, a seal ring and a washer comprising portions of the assembly shown in FIG. 1.

Ring member 12 preferably is provided at its outer edge with a segmented rim 64 which extends vertically upwardly (axially) above upper surface 46 of ring member 12 to where rim 64 has an enlarged radially outwardly extending flange-like lip 66. Rim 64 is shown as a plurality of circumferentially spaced segments, each designated 64 separated by vertical spaces or cut-out portions 70 extending downwardly to the height of upper surface 46 of ring member 12 as best seen in FIG. 4. When used in securing roof sheeting 23, spaces 70 permit water to pass through rim 64 when the water rises merely to the height of upper surface 46 of the ring member.

Figure 8:
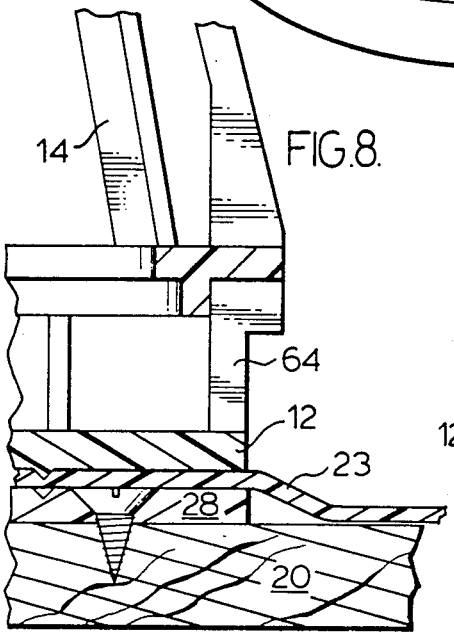
FIG. 8 shows an enlarged cross-sectional view of portions of the assembly in FIG. 1 clamping a roof sheeting.
Figure 9:
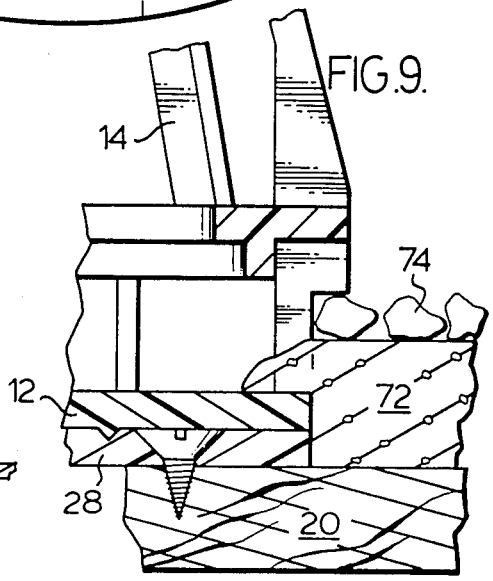
FIG. 9 shows a view similar to FIG. 8 but with a layer of asphalt and gravel substituted for the roof sheeting.

While FIGS. 1, 4 and 8 show use of a drain assembly in its preferred use with roof sheeting 23, the drain assembly can also be use with an asphalt type roof sealing system as shown in FIG. 9 in which a layer 72 of tar, asphalt or other sealant, preferably covered by gravel 74, may be poured directly over roof 20. In this case ring member 12 may be urged directly onto flange 28 as shown. Segmented rim 64 serves to help the asphalt or tar 72 and gravel 74 from entering the drain. Alternately, during re-roofing, either or both of felt or asphalt may be placed between ring member 12 and flange 28, preferably with a final layer of asphalt with gravel on top that butts up in a manner similar to that shown in FIG. 9.

In order to securely grip sheeting 23, as seen in FIG. 4, the lower surface 52 of ring member 12 may have one or more downwardly extending angular ridges 98. Preferably, complementary located and sized grooves 99 may be provided in the upper surface 36 of flange 28, to assist in gripping sheet 23 and also, as shown in FIG. 9 when no sheet is between the ring member 12 and flange 28, to accommodate ridges 98.

The drain assembly preferably has a straining basket 14 which prevents leaves, twigs, paper and the like from entering and clogging the drain. Basket 14 is shown to have a lower peripheral edge 75 with a downwardly extending inner projection 76 to closely contact the radially inside surface of rim 64. Preferably, three catch members 77 are provided on basket 14 as seen in FIG. 1. Catch members 77 engage under lip 66 to securely retain basket 14 onto ring member 12. With basket 14 having some resiliency, basket 14 may be snapped on and off of lip 66.

The lower end of tube portion 24 is preferably sealed to drain pipe 22. While this may be accomplished in a number of ways, a preferred construction is shown in FIGS. 1 and 5 to 7 in accordance with the teaching of U.S. Pat. No. 4,505,499 to Uglow et al. issued Mar. 19, 1985.

Tube portion 24 is recessed inwardly about lower opening 27 so as to provide outwardly thereof an annular space 80 to receive about tube portion 24 annular seal ring 16 and washer 18 in axially sliding relation. Washer 18 has three enlarged radially inwardly extending lugs 82 each carrying metal nuts 84 secured therein. Three screws 86 extend from radial lugs 88 of tube portion 24 downward to engage nuts 84 and draw washer 18 upwardly so as to compress elastomeric (rubber) seal ring 16. Ring 16 on being compressed is urged outwardly into sealing engagement with the inside wall 90 of drain pipe 22 as well as axially into the recessed, radially inwardly extending annular shoulder 92 of tube portion 24. As shown, annular space 80 is only of a radial inward extent equal to the thickness of ring 16 except at three places where it is enlarged under lugs 88 as at 94 to accommodate lugs 82 of washer 18. Lugs 88 present an upper flat surface which the head of screw 86 may engage between reinforcing flanges 96. Screws 86 are accessible through upper opening 26.

Preferably each of drain insert member 10, ring clamp member 12, straining basket 14 and washer 18 may be moulded from plastic as by injection moulding. The particular configuration of the post members permits moulding of the drain insert member with a two piece mould with the tube portion tapering a minor, insignificant amount downwardly. One piece of the mould may provide the upper and inside surfaces while the other piece of the mould may provide the lower and outer surfaces of the tube portion 24.

In practical application, a considerable number of different tube portions 24 need be provided, to closely correspond to the different inside diameters of drain pipes 22. These drain pipes may be either previously existing drain pipes being retrofitted or a new drain pipe. The system of coupling ring member 12 to flange 28 is such that ring members 12 and flanges 28 of identical dimensions can be used in association with tube portions 24 having smaller diameters than the tube portions 24 shown in solid lines in FIG. 1. For example, a tubular portion such as shown in FIG. 1 in dotted lines as **24*a* could be provided with flange member 28 modified but to extend further radially inwardly as 28*a*. This permits substantial saving in manufacturing cost in that a single mould component for flange 28 and post members 34 can be used with a number of different mould inserts to provide drain insert members having different diameter tube portions 24** but flange and post members of the same dimensions.

Advantageously, one size of clamp ring member 12 can be made to fit insert members 10 having different diameter tube portions. Thus a plurality of drain insert members with different tube diameters can be used but with the need to supply only a single size of clamp ring member and a single size of straining basket. This can significantly reduce inventor of clamp ring members and facilitate on site installation.

Providing the post members and socket forming members to be upstanding about the upper surfaces of the flange and the clamp ring member is advantageous where asphalt, tar or other sealing materials are to be applied and frequently are to be slopped onto a drain, making location of screw holes difficult.

With the post members having a blind end and effectively sealing the thread portion of screw member 60 therein, corrosion of the screw member is greatly reduced and the screw member can more easily be withdrawn after the passing of time if necessary.

In the preferred embodiment shown, the post members and socket forming members have been shown to be cylindrical. It is to be appreciated that many other complementary shape could also be used.

While the preferred embodiments show flange 28 as having a radius about equal to that of clamping ring 12, advantageously, flange 28 may have a substantially greater radius than clamping ring 12 to provide additional bonding to sheeting 23 or to avoid the need for conventional flashings.

While FIG. 4 shows grooves 99 complementary to ridges 98, sealing can be fully provided without grooves 99 or without both the groves or ridges. When grooves 99 are used, caution needs to be exercised to not unduly weaken flange 28.

Various systems can be used to retain basket 14 onto ring member 12. Preferred systems are ones which make it difficult for vandals or non-authorized persons to remove the basket. One such system could use three or more spring-loaded catch members partially hidden within the basket so as to be out of sight and require two or more to be simultaneously released to free the basket.

While the invention has been described with reference to preferred embodiments, the invention is not so limited. Many variations and modifications will now occur to those skilled in the art. For a definition of the invention, reference is made to the appended claims.

What I claim is:

1. A roof drain assembly comprising:

a drain insert member having a tube portion with an upper opening and a lower opening and flange means extending outwardly about the upper opening, a removable, thin, planar clamp ring member overlying the flange means with a central opening through the clamp ring member to provide access to the upper opening of the tube portion, a plurality of post members on the flange means extending upwardly beyond an upper surface of the flange means, each post member having a central aperture extending downwardly from the top of each post member into the post member but not entirely through the flange means, a plurality of socket forming members on the clamp ring member extending upwardly beyond an upper surface of the clamp ring member, each socket forming member defining therein a socket recess to receive one of the post members therein through an access opening to the socket recess in a lower surface of the clamp ring member, an entrance aperture through an upper end of each socket forming member downward into the socket recess, screw means extending downwardly via the entrance aperture into the socket recess to engage the central aperture of the post members and urge the clamping ring member downward into clamping engagement on top of the flange means.

2. An assembly as claimed in claim 1 wherein the drain insert member and clamp ring member each comprise unitary elements moulded from plastic.

3. An assembly as claimed in claim 1 further including means about the lower opening of the tubular portion for sealing the tubular portion to a drain pipe co-axially about the tubular portion.

4. An assembly as claimed in claim 1 wherein said tubular poriton is cylindrical, said flange means extends radially outwardly therefrom co-axially thereabout as a thin, planar flange member with said upper surface of the flange means comprising flat annular surface, and said lower surface of the clamp ring member substantially flat.

5. An assembly as claimed in claim 1 including means to couple the flange means to a roof.

6. An assembly as claimed in claim 5 including a thin, water impermeable roof covering sheeting having edges clamped between the clamp ring member and the flange means to form a sealed water impermeable junction with the sheeting entirely about the flange means.

7. An assembly as claimed in claim 6 wherein the means to couple the flange means to the roof comprises threaded fasteners extending downwardly through holes in the flange means located farther radially outward than the post members and underneath the edges of the sheeting.

8. An assembly as claimed in claim 7 further including means about the lower opening of the tubular poriton for sealing the tubular portion to a drain pipe co-axially about the tubular portion.

9. A roof drain assembly comprising:

a drain insert member having a tube portion with flange means extending outwardly about an upper opening of the tube portion, removable clamp ring means overlying the flange means, post means on the flange means extending upwardly from an upper surface of the flange means, socket forming means on the clamp ring means extending upwardly beyond an upper surface of the clamp ring means, a socket recess in each socket forming means to receive one of the post means therein through an access opening to the socket recess in a lower surface of the clamp ring member, screw means extending downwardly through the socket forming means into the socket recess to engage the post means and urge the clamping ring means downward into clamping engagement on top of the flange means.

10. An assembly as claimed in claim 9 wherein said tube portion is cylindrical, said flange means comprises a thin flange extending radially outwardly therefrom co-axially thereabout, and said clamp ring means comprises a thin, planar ring member.

* * * * *